US008191446B1

(12) United States Patent
Sherri

(10) Patent No.: US 8,191,446 B1
(45) Date of Patent: Jun. 5, 2012

(54) ADJUSTABLE SET WRENCH

(76) Inventor: Brad J. Sherri, Toronto (CA)

( * ) Notice: Subject to any disclaimer, the term of this patent is extended or adjusted under 35 U.S.C. 154(b) by 349 days.

(21) Appl. No.: 12/571,322

(22) Filed: Sep. 30, 2009

(51) Int. Cl.
*B25B 13/16* (2006.01)

(52) U.S. Cl. ..... 81/165

(58) Field of Classification Search ..... 81/165, 81/167, 155, 170, DIG. 5
See application file for complete search history.

(56) References Cited

U.S. PATENT DOCUMENTS 2,722,150 A * 11/1955 Green ..... 81/165
4,326,436 A * 4/1982 McGraw ..... 81/165
4,454,791 A * 6/1984 Seward, III ..... 81/133
5,297,459 A * 3/1994 Stojanowski ..... 81/165
5,331,868 A * 7/1994 Elmore ..... 81/165
5,345,636 A * 9/1994 Lamons ..... 7/139
5,540,125 A * 7/1996 Haskell ..... 81/170
5,548,903 A * 8/1996 Johnson et al. ..... 33/810
5,697,166 A * 12/1997 Hommel ..... 33/758
6,125,724 A * 10/2000 Murphy et al. ..... 81/133
7,013,763 B2 * 3/2006 Hsien ..... 81/165
7,284,465 B1 * 10/2007 Chen ..... 81/165

* cited by examiner

*Primary Examiner* — Debra S Meislin

(57) ABSTRACT

An adjustable set wrench includes a wrench handle; an adjustable wrench head provided on the wrench handle and having a stationary jaw, an adjustable jaw and a wrench gap between the stationary jaw and the adjustable jaw; at least one of a metric jaw adjustment scale having metric marking units and a standard jaw adjustment scale having standard marking units provided on the adjustable wrench head; and at least one of a metric jaw mark and a standard jaw mark provided on the adjustable jaw and registering with at least one of the metric marking units and the standard marking units.

7 Claims, 7 Drawing Sheets

ADJUSTABLE SET WRENCH

FIELD OF THE INVENTION

The present disclosure relates to wrenches. More particularly, the present disclosure relates to an adjustable set wrench which can be precisely adjusted to fit nuts and bolts of various sizes.

BACKGROUND OF THE INVENTION

Conventional set wrenches include an elongated handle which terminates in an adjustable wrench head having a fixed jaw and an adjustable jaw. The adjustable jaw is selectively movable with respect to the fixed jaw to vary the spacing between the jaws depending on the size or width of a nut or bolt head which is engaged by the wrench for loosening and tightening. However, while they typically have gross adjusting capability, conventional set wrenches typically cannot be precisely adjusted to a particular width depending on the size or width of the nut or bolt which is to be tightened or loosened. Thus, slippage of the wrench with respect to the nut or bolt may occur, resulting in stripping of the nut or bolt over time.

SUMMARY OF THE INVENTION

The present disclosure is generally directed to an adjustable set wrench. An illustrative embodiment of the adjustable set wrench includes a wrench handle; an adjustable wrench head provided on the wrench handle and having a stationary jaw, an adjustable jaw and a wrench gap between the stationary jaw and the adjustable jaw; at least one of a metric jaw adjustment scale having metric marking units and a standard jaw adjustment scale having standard marking units provided on the adjustable wrench head; and at least one of a metric jaw mark and a standard jaw mark provided on the adjustable jaw and registering with at least one of the metric marking units and the standard marking units.

BRIEF DESCRIPTION OF THE DRAWINGS

The disclosure will now be made, by way of example, with reference to the accompanying drawings, in which.

DETAILED DESCRIPTION

Figure 1:
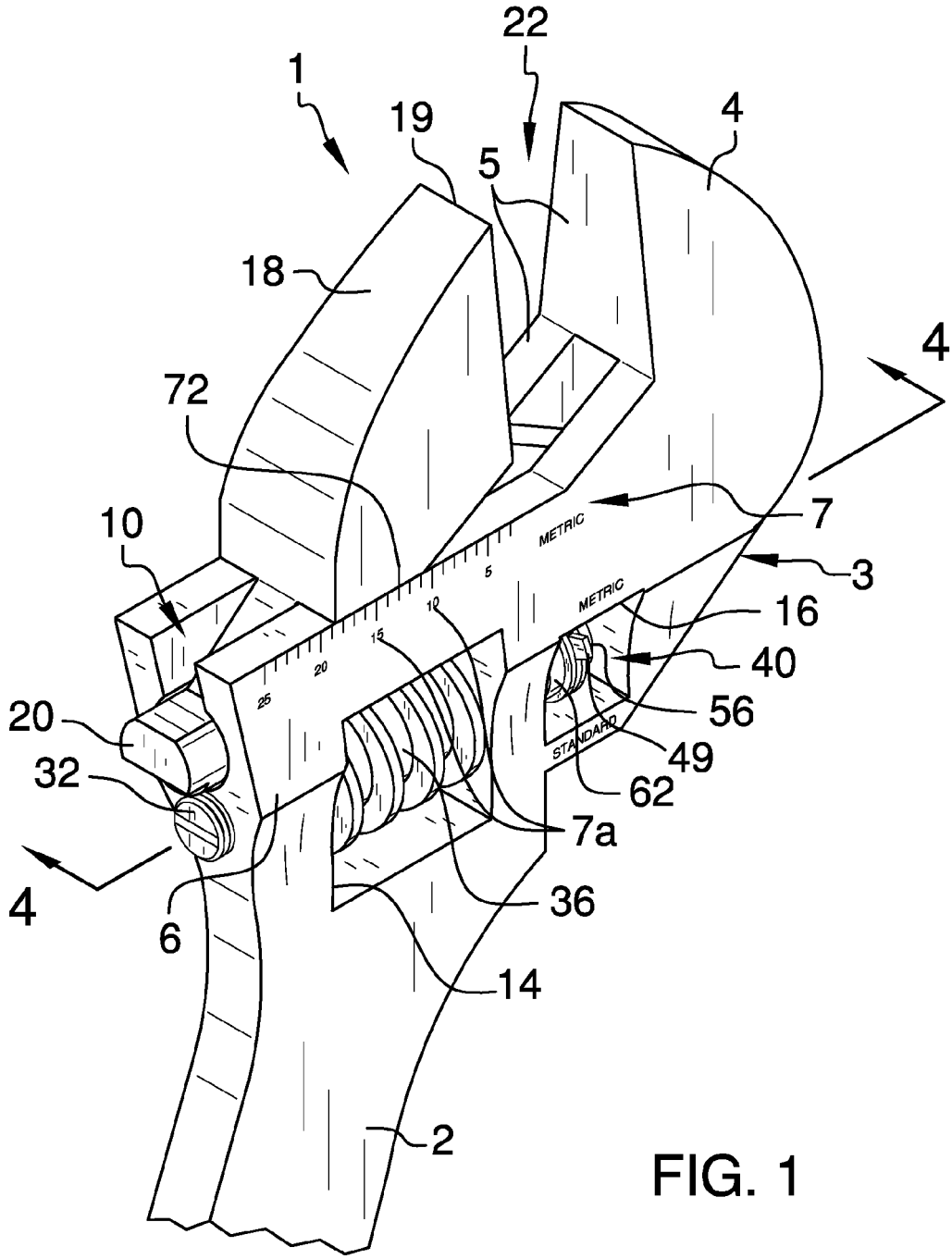
FIG. 1 is a perspective view, partially in section, of an adjustable wrench head of an illustrative embodiment of the adjustable set wrench.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure which is defined by the claims.

Furthermore, there is no intention to be bound by any expressed or implied theory presented in the preceding technical field, background, brief summary or the following detailed description.

Referring to the drawings, an illustrative embodiment of the adjustable set wrench is generally indicated by reference numeral 1. The adjustable set wrench 1 includes a generally elongated wrench handle 2. An adjustable wrench head 3 may be provided on the wrench handle 2. The adjustable wrench head 3 may include a generally elongated head base 6. A stationary jaw 4 having stationary jaw surfaces 5 may be provided at one end of the head base 6.

An adjustable jaw 18 is adjustably mounted on the head base 6 and can be positioned at selected spacings with respect to the stationary jaw 4. A wrench gap 22 may be defined between the stationary jaw 4 and the adjustable jaw 18. The adjustable jaw 18 may have adjustable jaw surfaces 19 which generally face the stationary jaw surfaces 5 of the stationary jaw 4 in the wrench gap 22. The stationary jaw surfaces 5 of the stationary jaw 4 and the and the adjustable jaw surfaces 19 of the adjustable jaw 18 may be suitably configured to engage flat surfaces (not shown) on a bolt head or a nut (not shown), for example and without limitation.

Figure 2:
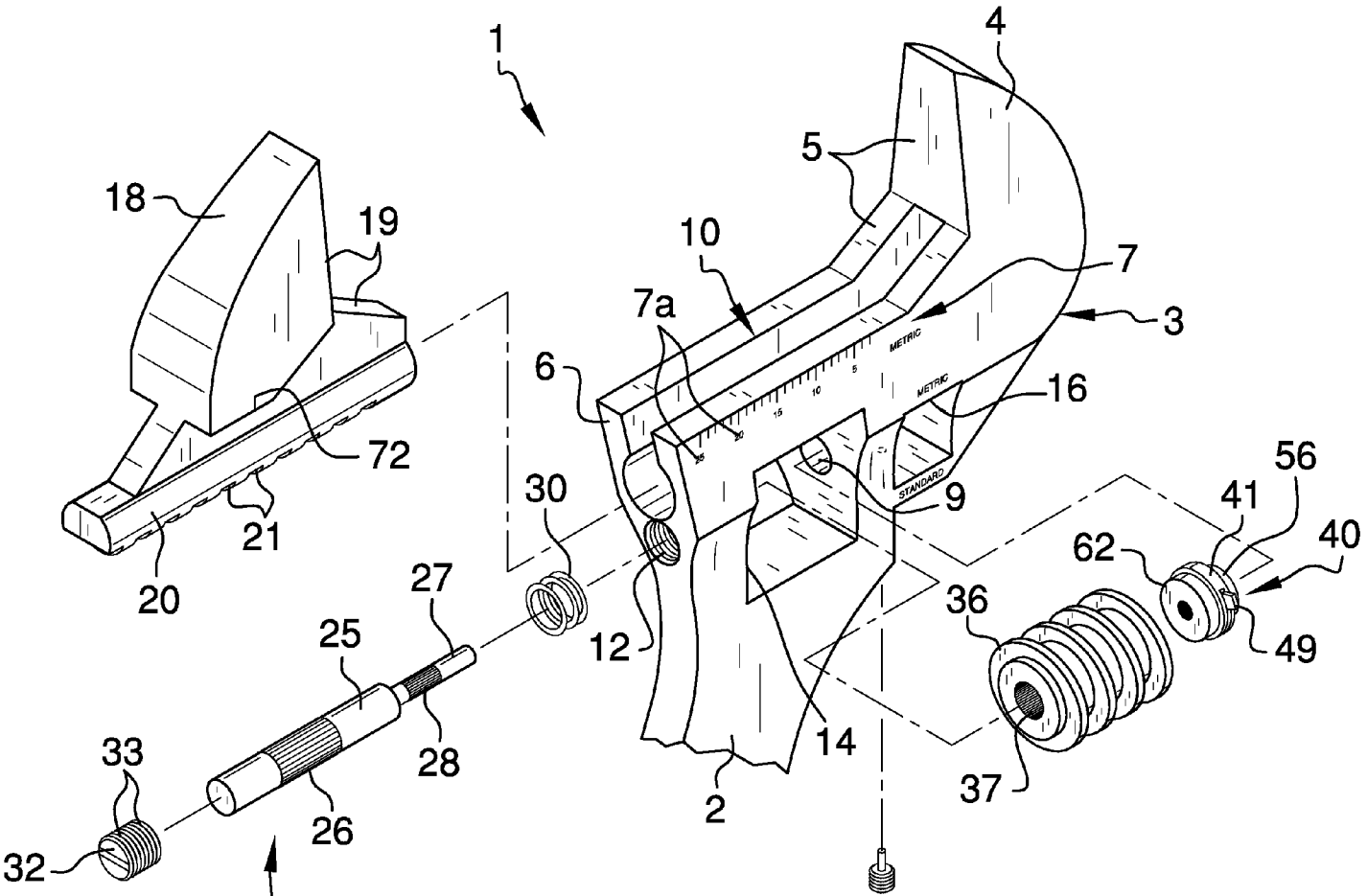
FIG. 2 is an exploded perspective view, partially in section, of an illustrative embodiment of the adjustable set wrench.

The adjustable jaw 18 may be adjustably mounted on the head base 6 according to any suitable technique which is known by those skilled in the art. In some embodiments, a generally elongated jaw channel 10 may be provided in the head base 6. The adjustable jaw 18 may include an adjustable jaw base 20 which is slidably mounted in the jaw channel 10. As shown in FIG. 2, multiple base grooves 21 may be provided in the jaw base 20 for purposes which will be hereinafter described.

Figure 3:
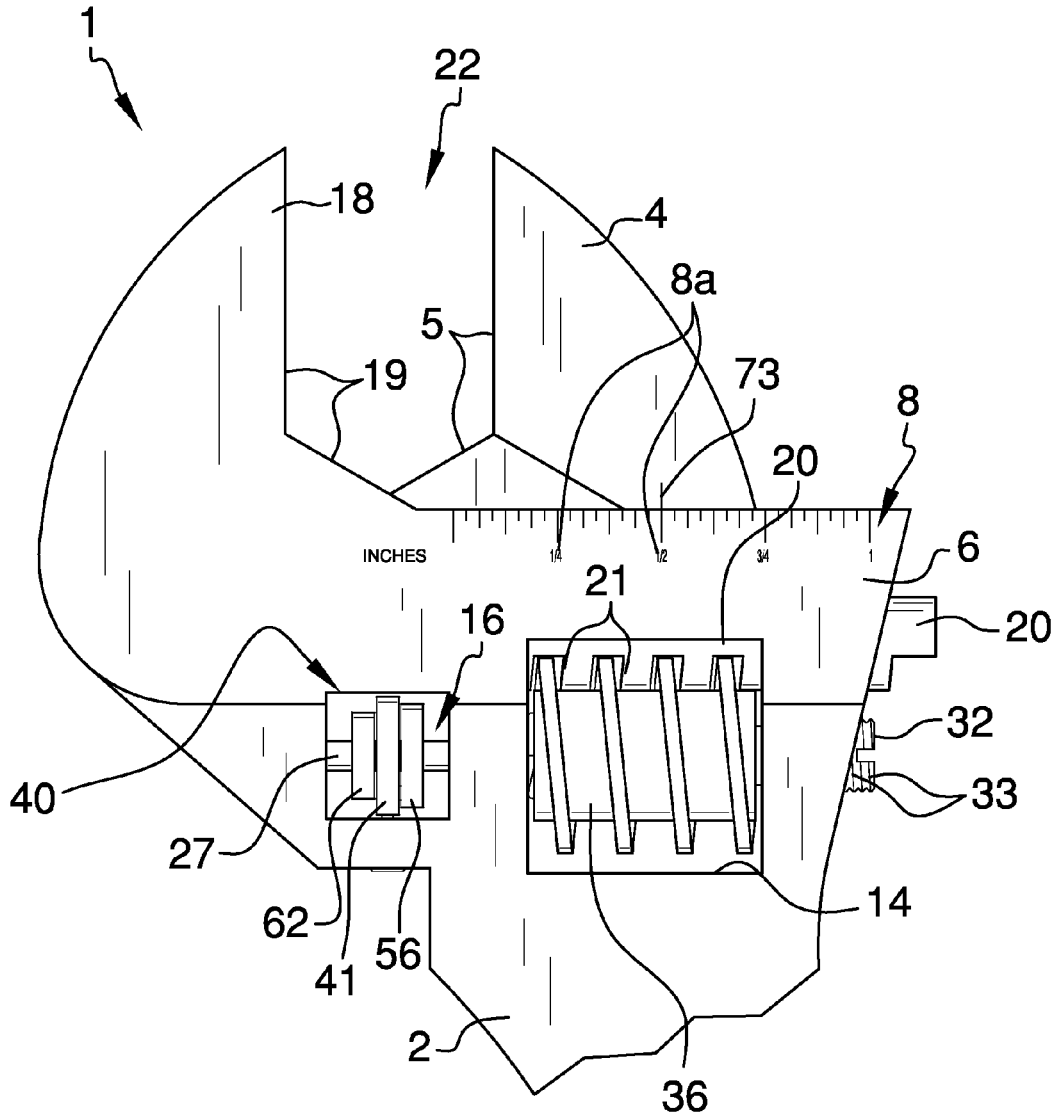
FIG. 3 is a front view, partially in section, of an illustrative embodiment of the adjustable set wrench.

As shown in FIGS. 1 and 2 of the drawings, a metric jaw adjustment scale 7 may be provided on a first surface of the head base 6 in metric marking units 7*a*. A metric jaw mark 72 provided on the adjustable jaw 18 registers with the metric marking units 7*a* of the metric jaw adjustment scale 7. As shown in FIG. 3, a standard jaw adjustment scale 8 may be provided on a second surface of the head base 6 in standard English marking units 8*a*. A standard jaw mark 73 provided on the adjustable jaw 18 registers with the standard marking units 8*a* of the standard jaw adjustment scale 8. Each metric marking unit 7*a* may indicate the width of the wrench gap 22 when the metric jaw mark 72 on the adjustable jaw 18 registers with that metric marking unit 7*a*. Similarly, each standard marking unit 8*a* may indicate the width of the wrench gap 22 when the standard jaw mark 73 on the adjustable jaw 18 registers with that standard marking unit 8*a*.

A rod assembly 24 is provided in the wrench head of the adjustable set wrench 1 to facilitate selective travel of the adjustable jaw 18 on the head base 6 and adjustment of the width of the wrench gap 22. In some embodiments, the rod assembly 24 may include a generally elongated bearing adjustment rod 25. The bearing adjustment rod 25 may extend through a rod opening 9 (FIG. 2) provided in the wrench head 3. A rotatable worm screw 36 may be provided on the bearing adjustment rod 25 and engage the base grooves 21 in the jaw base 20 of the adjustable jaw 18. The worm screw 36 may have a grooved screw interior 37 which engages and seats on a grooved worm screw seat 26 provided on the bearing adjustment rod 25. Thus, the bearing adjustment rod 25 may rotate with the worm screw 36 as the worm screw 36 is rotated in the worm screw cavity 14. The bearing adjustment rod 25 may be retained in the rod opening 9 by a set screw 32 having set screw threads 33 which engage interior threads (not numbered) provided in a set screw opening 12 in the wrench head 3. A spring 30 may be provided on the bearing adjustment rod 25 to normally bias the bearing adjustment rod 25 toward the inlet of the set screw opening 12.

In some embodiments, the worm screw 36 may be provided inside a worm screw cavity 14 provided in the wrench head 3. Accordingly, clockwise or counterclockwise rotation of the worm screw 36 on the bearing adjustment rod 25 and in the worm screw cavity 14 causes the worm screw 36 to progressively engage the base grooves 21 in the jaw base 20 of the adjustable jaw 18. This rotating action of the worm screw 36 slides the adjustable jaw 18 toward or away from the stationary jaw 4 to decrease or increase, respectively, the width of the wrench gap 22.

In some embodiments, a bearing lock assembly 40 may be provided in the wrench head 3. The bearing lock assembly 40 may be adapted to emit a clicking sound as the metric jaw mark 72 on the adjustable jaw 18 registers with the respective metric marking units 7*a* of the metric jaw adjustment scale 7 or as the standard jaw mark 73 on the adjustable jaw 18 registers with the respective standard marking units 8*a* of the standard jaw adjustment scale 8. Accordingly, the bearing lock assembly 40 may have separate settings for the metric jaw adjustment scale 7 and the standard jaw adjustment scale 8.

Figure 5:
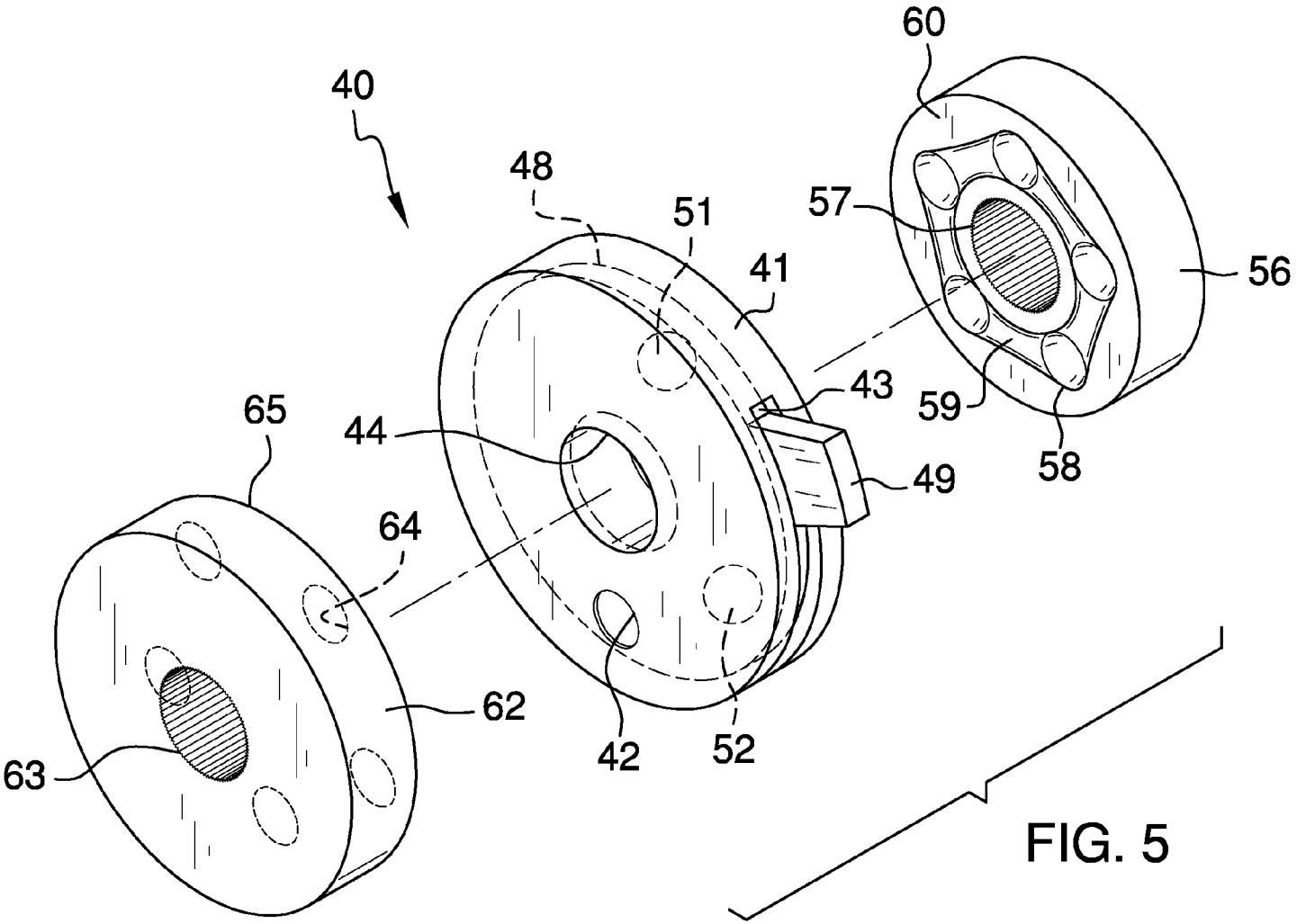
FIG. 5 is an exploded perspective view of a bearing lock assembly of an illustrative embodiment of the adjustable set wrench, with the bearing lock assembly set to a standard use setting.
Figure 6:
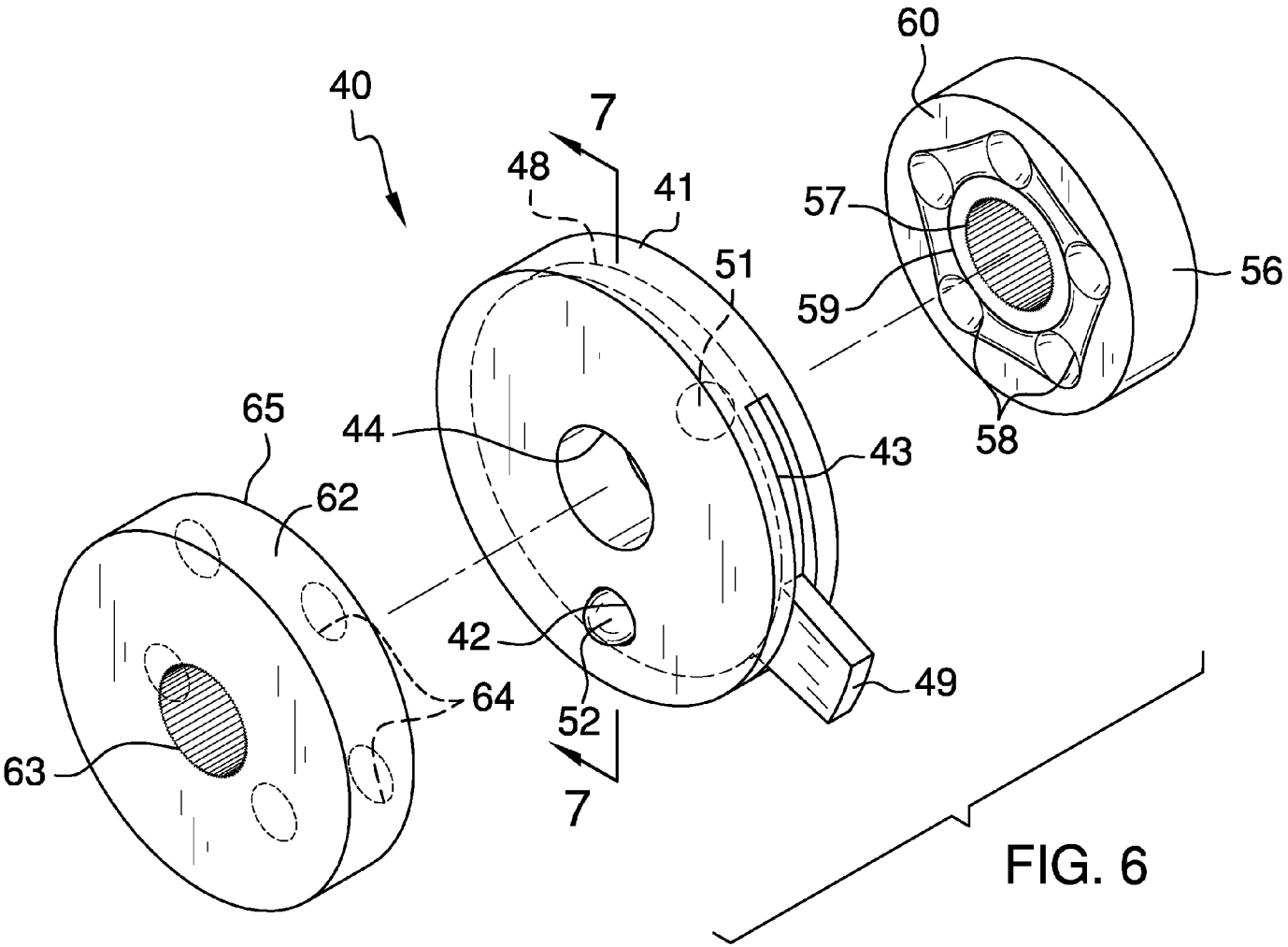
FIG. 6 is an exploded perspective view of the bearing lock assembly of an illustrative embodiment of the adjustable set wrench, with the bearing lock assembly set to a metric use setting.
Figure 7:
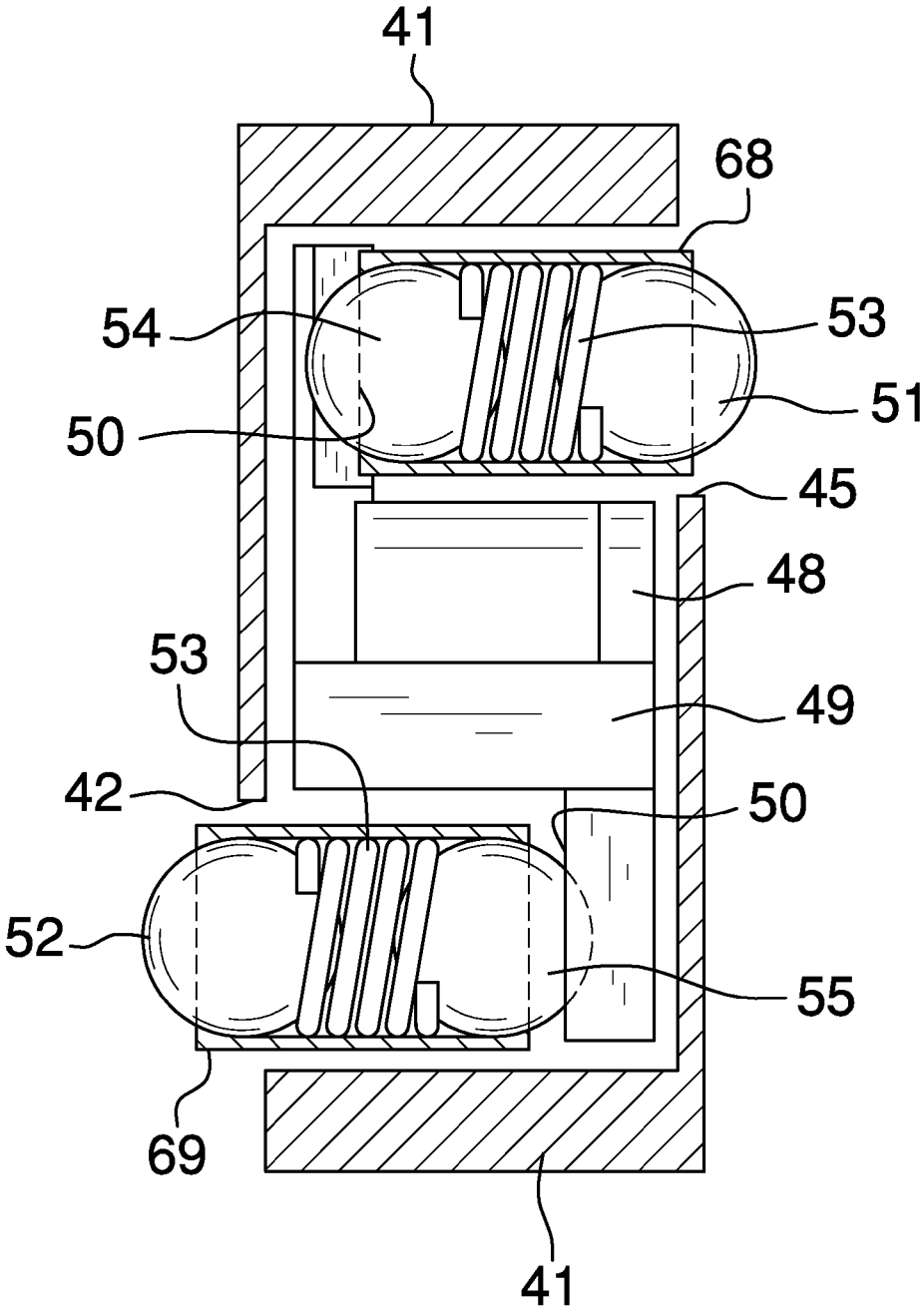
FIG. 7 is a sectional view, taken along section lines 7-7 in FIG. 6.

As shown in FIG. 2, the bearing lock assembly 40 may be provided on a rod pin 27 which extends from the jaw adjustment rod 27. In some embodiments, the bearing lock assembly 40 may be accommodated inside a bearing lock opening 16 provided in the wrench head 3. As shown in FIGS. 5 and 6, the bearing lock assembly 40 may include a generally cylindrical bearing lock housing 41. As shown in FIG. 7, a standard bearing opening 42 and a metric bearing opening 45 may be provided in opposite sides of the bearing lock housing 41. A disk tab slot 43 may be provided in the circumferential surface of the bearing lock housing 41. A central disk opening 44 may extend through the bearing lock housing 41.

As shown in FIG. 7, an internal bearing disk 48 may be provided inside the bearing lock housing 41. A pair of tapered or ramp-shaped bearing engaging surfaces 50 may be provided in the internal bearing disk 48. A first inside ball bearing 54 engages one of the bearing engaging surfaces 50. A bearing spring 53 engages the first inside ball bearing 54, and a metric ball bearing 51 engages the bearing spring 53. A second inside ball bearing 55 engages the other one of the bearing engaging surfaces 50. A bearing spring 53 engages the second inside ball bearing 55, and a standard ball bearing 52 engages the bearing spring 53. The metric ball bearing 51 and its bearing spring 53 and the first inside ball bearing 54 may be contained inside a metric spring cassette 68. Likewise, the standard ball bearing 52 and its bearing spring 53 and the second inside ball bearing 55 may be contained inside a standard spring cassette 69. A disk tab 49 may extend outwardly from the internal bearing disk 48 and through the disk tab slot 43. Accordingly, responsive to sliding the disk tab 49 to a first position in the disk tab slot 43, as shown in FIG. 5, the internal bearing disk 48 rotates in the bearing lock housing 41 such that one of the ramp-shaped bearing engaging surfaces 50 "ramps up" and protrudes the metric ball bearing 51 from the metric bearing opening 45 in the bearing lock housing 41 via the first inside ball bearing 54 and the intervening bearing spring 53. Simultaneously, the other ramp-shaped bearing engaging surface 50 "ramps down" such that the standard ball bearing 52 is pushed into the standard bearing opening 42 in the bearing lock housing typically in a manner which will be hereinafter described. Conversely, responsive to sliding the disk tab 49 to a second position in the disk tab slot 43, as shown in FIG. 6, the internal bearing disk 48 rotates in the bearing lock housing 41 such that the corresponding ramp-shaped bearing engaging surface 50 "ramps up" and protrudes the standard ball bearing 52 from the standard bearing opening 42 in the bearing lock housing 41 via the second inside ball bearing 55 and the intervening bearing spring 53. Simultaneously, the corresponding ramp-shaped bearing engaging surface 50 "ramps down" such that the metric ball bearing 51 is pushed into the metric bearing opening 45 in the bearing lock housing 41 typically in a manner which will be hereinafter described.

As further shown in FIGS. 5 and 6, the bearing lock assembly 40 may further include a generally disk-shaped or cylindrical metric bearing disk 56 which is positioned on the side of the bearing lock housing 41 which corresponds to the metric bearing opening 45 (FIG. 7). The metric bearing disk 56 may have a splined central disk opening 57. Multiple, spaced-apart ball bearing indents 58 may be provided in an inner face 60 of the metric bearing disk 56. Ball bearing channels 59 provided in the inner face 60 may connect the ball bearing indents 58 to each other. A generally disk-shaped or cylindrical standard bearing disk 62 may be positioned on the side of the bearing lock housing 41 which corresponds to the standard bearing opening 42 (FIG. 7). The standard bearing disk 62 may have a splined central disk opening 63. Multiple, spaced-apart ball bearing indents 64 may be provided in an inner face 65 of the standard bearing disk 48. Although not shown in FIGS. 5 and 6, ball bearing channels provided in the inner face 65 may connect the ball bearing indents 64 to each other. The ball bearing indents 58 and the ball bearing channels 59 (FIGS. 5 and 6) of the metric bearing disk 56 interface with the metric bearing opening 45 (FIG. 7) provided in the bearing lock housing 41. Similarly, the ball bearing indents 64 (FIGS. 5 and 6) and the ball bearing channels (not shown) of the standard bearing disk 62 interface with the standard bearing opening 42 (FIG. 7) provided in the bearing lock housing 41.

As shown in FIG. 2, the bearing lock assembly 40 may be provided in a bearing lock opening 16 which is provided in the wrench head 3. A splined bearing lock seat 28 provided on the rod pin 27 of the bearing adjustment rod 25 drivingly engages the metric bearing disk 56 through the splined disk opening 57 and the standard bearing disk 62 through the splined disk opening 63. The bearing lock housing 41 is stationary with respect to the rod pin 27. Accordingly, as it is rotated in the worm screw cavity 14, the worm screw 36 rotates the bearing adjustment rod 25 in the rod opening 9. In turn, the bearing adjustment rod 25 rotates the metric bearing disk 56 and the standard bearing disk 62 while the bearing lock housing 41 of the bearing lock assembly 40 remains stationary on the bearing adjustment rod 25. Therefore, when the disk tab 49 is disposed in the metric position shown in FIG. 5, the metric ball bearing 51 extends through the metric bearing opening 45, as was heretofore described with respect to FIG. 7, and into one of the ball bearing indents 58 or ball bearing channels 59 in the metric bearing disk 56. Likewise, when the disk tab 49 is disposed in the standard position shown in FIG. 6, the standard ball bearing 52 extends through the standard bearing opening 42, as was heretofore described with respect to FIG. 7, and into one of the ball bearing indents 64 or ball bearing channels (not shown) in the standard bearing disk 62.

Figure 4:
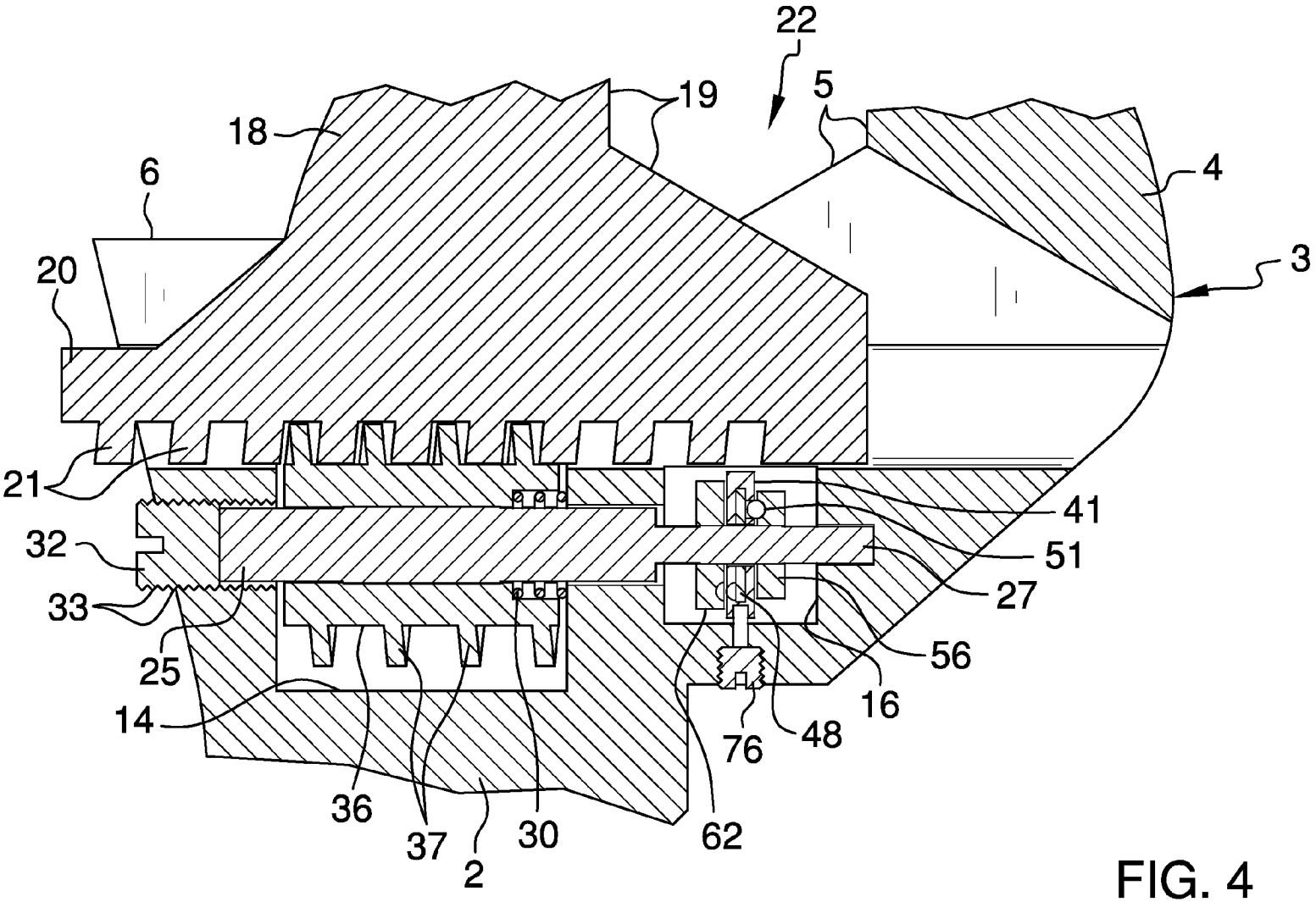
FIG. 4 is a sectional view, taken along section lines 4-4 in FIG. 1.

When the disk tab 49 is disposed in the metric position shown in FIG. 5, the protruding metric ball bearing 51 progressively travels through the ball bearing channels 59 and snaps into the respective ball bearing indents 58 of the metric bearing disk 56 as the worm screw 36 moves the adjustable jaw 18 along the head base 6 and simultaneously rotates the bearing adjustment rod 25 in the rod opening 9. The snapping sounds rendered by the metric ball bearing 51 as it is biased into the ball bearing indents 58 corresponds in time to registration of the respective metric jaw mark 72 (FIG. 2) provided on the adjustable jaw 18 with the respective metric marking units 7*a* of the metric jaw adjustment scale 7. Conversely, when the disk tab 49 is disposed in the standard position shown in FIG. 6, the protruding standard ball bearing 52 progressively travels through the ball bearing channels (not shown) and snaps into the respective ball bearing indents 64 of the standard bearing disk 62 as the worm screw 36 is rotated. The snapping sounds rendered by the standard ball bearing 52 as it is biased into the ball bearing indents 64 corresponds in time to registration of the respective standard jaw mark 73 (FIG. 3) provided on the adjustable jaw 18 with the respective standard marking units 8*a* of the standard jaw adjustment scale 8. As shown in FIG. 4, in some embodiments a bearing set screw 76 may threadably engage the wrench head 3 for selective engagement with the bearing lock housing 41 of the bearing lock assembly 40 to selectively lock the internal bearing disk 48 in the metric position or the standard position.

In typical application, the adjustable set wrench 1 may be used to tighten or loosen a bolt (not shown) or a nut (not shown). The worm screw 36 may be rotated to adjust the position of the adjustable jaw 18 along the head base 6 of the wrench head 3 and precisely size the wrench gap 22 according to the size or width of the bolt or nut. The metric jaw mark 72 on the adjustable jaw 18 registers with the metric marking units 7*a* of the metric jaw adjustment scale 7 to indicate the corresponding width of the wrench gap 22 in metric units. In like manner, the standard jaw mark 73 on the adjustable jaw 18 registers with the standard marking units 8*a* of the standard jaw adjustment scale 8 to indicate the corresponding width of the wrench gap 22 in standard units. The disk tab 49 of the bearing assembly 40 may be disposed in the metric position (FIG. 5) to produce clicking sounds as the metric jaw mark 72 registers with the respective metric marking units 7*a* of the metric adjustment scale 7. The disk tab 49 of the bearing assembly 40 may be disposed in the standard position (FIG. 6) to produce clicking sounds as the standard jaw mark 73 registers with the respective standard marking units 8*a* of the standard adjustment scale 8. The fine-tuning adjustment capabilities of the adjustable set wrench 1 may facilitate precise sizing of the width of the wrench gap 22 to the size or width of the nut or bolt (not shown) which is engaged by the wrench head 3. This may prevent or minimize slippage of the wrench head 3 during tightening or loosening of the nut or bolt and therefore, prevent or minimize stripping of the nut or bolt.

While the preferred embodiments of the disclosure have been described above, it will be recognized and understood that various modifications can be made in the disclosure and the appended claims are intended to cover all such modifications which may fall within the spirit and scope of the disclosure.

What is claimed is:

1. An adjustable set wrench, comprising:

a wrench handle;

an adjustable wrench head provided on the wrench handle and having a stationary jaw, an adjustable jaw and a wrench gap between the stationary jaw and the adjustable jaw;

at least one of a metric jaw adjustment scale having metric marking units and a standard jaw adjustment scale having standard marking units provided on the adjustable wrench head;

at least one of a metric jaw mark and a standard jaw mark provided on the adjustable jaw and registering with at least one of the metric marking units and the standard marking units;

a worm screw engaging the adjustable jaw; and a rod assembly carried by the adjustable wrench head and drivingly engaged by the worm screw and a bearing lock assembly drivingly engaged by the rod assembly and adapted to produce clicking noises as the at least one of a metric jaw mark and a standard jaw mark provided on the adjustable jaw registers with at least one of the metric marking units and the standard marking units;

wherein the bearing lock assembly comprises a bearing lock housing carried by the rod assembly, an internal bearing disk provided in the bearing lock housing, a metric ball bearing engaged by the internal bearing disk and extendable from the bearing lock housing, a standard ball bearing engaged by the internal bearing disk and extendable from the bearing lock housing, a metric bearing disk drivingly engaged by the rod assembly, a plurality of ball bearing indents provided in the metric bearing disk and adapted to receive the metric ball bearing, a standard bearing disk drivingly engaged by the rod assembly and plurality of ball bearing indents provided in the standard bearing disk and adapted to receive the standard ball bearing.

2. The adjustable set wrench of claim 1 further comprising a worm screw cavity provided in the adjustable wrench head and wherein the worm screw is provided in the worm screw cavity.

3. The adjustable set wrench of claim 2 further comprising a bearing lock opening provided in the adjustable wrench head and wherein the bearing lock assembly is provided in the bearing lock opening.

4. The adjustable set wrench of claim 1 further comprising a first plurality of ball bearing channels connecting the ball bearing indents of the metric bearing disk and a second plurality of ball bearing channels connecting the ball bearing indents of the standard bearing disk.

5. The adjustable set wrench of claim 1 further comprising a bearing set screw carried by the adjustable wrench head and engaging the internal bearing disk of the bearing lock assembly.

6. The adjustable set wrench of claim 1 wherein the adjustable wrench head comprises a head base carried by the wrench handle and a jaw channel provided in the head base, and further comprising an adjustable jaw base carried by the adjustable jaw and slidably engaging the jaw channel.

7. An adjustable set wrench, comprising:

a wrench handle;

an adjustable wrench head having a head base provided on the wrench handle, a jaw channel provided in the head base, a stationary jaw carried by the head base, an adjustable jaw slidably engaging the jaw channel and a wrench gap defined between the stationary jaw and the adjustable jaw;

at least one of a metric jaw adjustment scale having metric marking units and a standard jaw adjustment scale having standard marking units provided on the adjustable wrench head;

at least one of a metric jaw mark and a standard jaw mark provided on the adjustable jaw and registering with at least one of the metric marking units and the standard marking units;

a worm screw carried by the adjustable wrench head and engaging the adjustable jaw;

a rod assembly carried by the adjustable wrench head and drivingly engaged by the worm screw;

a bearing lock assembly drivingly engaged by the rod assembly and adapted to produce clicking noises as the at least one of a metric jaw mark and a standard jaw mark provided on the adjustable jaw registers with at least one of the metric marking units and the standard marking units;

wherein the bearing lock assembly comprises:

a bearing lock housing carried by the rod assembly;

a disk tab slot provided in the bearing lock housing an internal bearing disk provided in the bearing lock housing and having first and second ramp-shaped bearing engaging surfaces and a disk tab extending from the internal bearing disk through the disk tab slot;

a metric ball bearing engaged by the first bearing engaging surface of the internal bearing disk and extendable from the bearing lock housing;

a standard ball bearing engaged by the second bearing engaging surface of the internal bearing disk and extendable from the bearing lock housing;

a metric bearing disk drivingly engaged by the rod assembly;

a plurality of ball bearing indents provided in the metric bearing disk and adapted to receive the metric ball bearing;

a plurality of ball bearing channels connecting the plurality of ball bearing indents;

a standard bearing disk drivingly engaged by the rod assembly; and a plurality of ball bearing indents provided in the standard bearing disk and adapted to receive the standard ball bearing and a plurality of ball bearing channels connecting the plurality of ball bearing indents; and a bearing set screw carried by the adjustable wrench head and engaging the internal bearing disk of the bearing lock assembly.

* * * * *